US011158963B2

(12) United States Patent
Maruno

(10) Patent No.: US 11,158,963 B2
(45) Date of Patent: Oct. 26, 2021

(54) CONNECTOR DEVICE

(71) Applicant: HIROSE ELECTRIC CO., LTD., Tokyo (JP)

(72) Inventor: Kazuhiro Maruno, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/869,038

(22) Filed: May 7, 2020

(65) Prior Publication Data

US 2020/0366008 A1 Nov. 19, 2020

(30) Foreign Application Priority Data

May 16, 2019 (JP) ..... JP2019-092591

(51) Int. Cl.

| | |
|---|---|
| ***H01R 12/50*** | (2011.01) |
| ***H01R 12/51*** | (2011.01) |
| ***H01R 12/75*** | (2011.01) |
| ***H01R 12/53*** | (2011.01) |
| ***H01R 13/05*** | (2006.01) |

(52) U.S. Cl.

CPC ..... *H01R 12/515* (2013.01); *H01R 12/53* (2013.01); *H01R 12/75* (2013.01); *H01R 13/055* (2013.01)

(58) Field of Classification Search

CPC ..... H01R 12/515; H01R 12/15; H01R 12/50; H01R 12/53; H01R 12/75; H01R 12/72; H01R 13/055; H01R 13/05; H01R 13/04; H01R 13/00

USPC ... 439/78, 540.1, 541.5, 581, 582, 623, 660, 439/676, 492, 493, 607.07, 607.09, 439/607.11, 607.32, 620.06, 620.12, (Continued)

(56) References Cited

U.S. PATENT DOCUMENTS 3,873,172 A * 3/1975 Paullus ..... H01R 12/78 439/498
4,533,187 A * 8/1985 Kirkman ..... H05K 7/1038 439/736

(Continued)

FOREIGN PATENT DOCUMENTS

JP 2007-134217 A 5/2007

*Primary Examiner* — Harshad C Patel
(74) *Attorney, Agent, or Firm* — Rankin, Hill & Clark LLP

(57) ABSTRACT

Provided is a connector device including a cable-side connector and a board-side connector. The cable-side connector has a cable-side housing and a plurality of cable connection terminals having pin-shaped contact portions, the cable connection terminal is configured to be connected to one end of a cable, and is provided in the cable-side housing, the board-side connector includes a board-side housing and a plurality of board fixing terminals, each board fixing terminal has a portion to be housed and an extending portion, the portion to be housed has an elastic contact piece and a closing portion, and is housed elastically displaceable inside each of a plurality of terminal housing spaces provided in the board-side housing, the extending portion extends to an outside through an opening of the terminal housing space, and is configured to be used by being fixed to a board, the elastic contact piece is configured to elastically contact the pin-shaped contact portion when the cable-side connector and the board-side connector are connected to each other, and the closing portion substantially closes the opening of the terminal housing space.

11 Claims, 8 Drawing Sheets

(58) Field of Classification Search
USPC ..... 439/607.15, 607.25, 850–859, 862, 867, 439/626
See application file for complete search history.

(56) References Cited

U.S. PATENT DOCUMENTS

| | | | | |
|---|---|---|---|---|
| 6,736,651 | B2 * | 5/2004 | Ho | H01R 12/725 439/540.1 |
| 6,863,549 | B2 * | 3/2005 | Brunker | H01R 13/6476 439/108 |
| 6,966,789 | B2 * | 11/2005 | Takaku | H01R 13/6275 439/353 |
| 7,581,978 | B1 * | 9/2009 | Briant | H01R 13/6275 439/358 |
| 8,534,074 | B2 * | 9/2013 | Copeland | F02C 7/277 60/772 |
| 9,525,227 | B2 * | 12/2016 | Little | H01R 12/75 |
| 2011/0287666 | A1 * | 11/2011 | Nishi | H01R 4/028 439/660 |
| 2014/0187085 | A1 * | 7/2014 | Nishimura | H01R 13/6273 439/578 |
| 2014/0273555 | A1 * | 9/2014 | Chawla | H01R 12/57 439/78 |
| 2016/0372872 | A1 * | 12/2016 | Orris | H01R 13/707 |
| 2017/0294730 | A1 * | 10/2017 | Inaka | H01R 13/17 |
| 2018/0040977 | A1 * | 2/2018 | Zhao | H01R 13/6273 |

* cited by examiner

CONNECTOR DEVICE

CROSS-REFERENCE TO RELATED APPLICATION

This application claims priority from Japanese Patent Application No. 2019-092591 filed with the Japan Patent Office on May 16, 2019, the entire content of which is hereby incorporated by reference.

BACKGROUND

1. Technical Field

The present disclosure relates to a connector device.

2. Description of the Related Art

The connector device having a cable-side connector and a board-side connector is known. More specifically, the connector device employing a plurality of terminals having pin-shaped contact portions and a plurality of terminals having elastic contact pieces in contact with the pin-shaped contact portions, and the board-side connector used in the connector device is known. The connector devices used in environments susceptible to vibrations and shocks such as automobiles and other vehicle devices are required to have high contact reliability between terminals provided on the connector. Therefore, in many cases, the terminal having a pin-shaped contact portion (hereinafter referred to as a "pin-shaped terminal" for convenience) and the terminal having an elastic contact piece (hereinafter referred to as an "elastic terminal" for convenience) that can contact the pin-shaped contact portion and absorb the vibrations or the like are used in combination.

In this case, as disclosed in JP-A-2007-134217 and many other literatures, the pin-shaped terminal is generally used for the board-side connector. On the other hand, the elastic terminal is used for the cable-side connector. This has a processing reason that the pin-shaped terminal can be easily and inexpensively manufactured by integrally resin-molding a pin-shaped portion of the pin-shaped terminal with a housing of the board-side connector. There is also a functional reason that a dustproof function and a waterproof function can be improved by filling a gap between the pin-shaped terminal and the housing by integral resin-molding.

SUMMARY

A connector device according to an embodiment of the present disclosure includes a cable-side connector and a board-side connector. The cable-side connector has a cable-side housing and a plurality of cable connection terminals having pin-shaped contact portions, the cable connection terminal is configured to be connected to one end of a cable, and is provided in the cable-side housing, the board-side connector includes a board-side housing and a plurality of board fixing terminals, each board fixing terminal has a portion to be housed and an extending portion, the portion to be housed has an elastic contact piece and a closing portion, and is housed elastically displaceable inside each of a plurality of terminal housing spaces provided in the board-side housing, the extending portion extends to an outside through an opening of the terminal housing space, and is configured to be used by being fixed to a board, the elastic contact piece is configured to elastically contact the pin-shaped contact portion when the cable-side connector and the board-side connector are connected to each other, and the closing portion substantially closes the opening of the terminal housing space.

DETAILED DESCRIPTION

Figure 1:
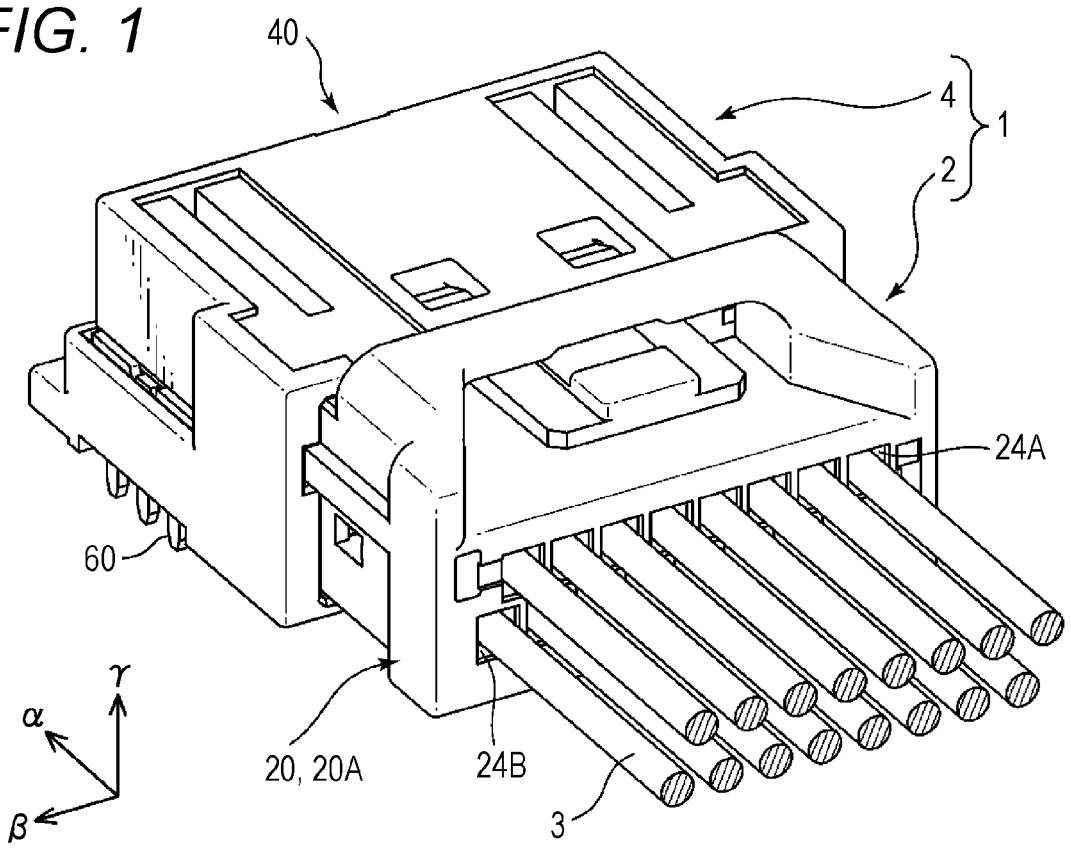
FIG. 1 is a perspective view of a connector device according to the present embodiment after mating, as viewed from a cable-side connector side.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In particular, after manufacturing a board-side connector, in many cases, so-called probe inspection of a board-side connector is performed to check board connection. In the probe inspection, an ultra-fine inspection needle called a probe pin contacts each pin-shaped terminal arranged in a housing of the board-side connector.

In recent years, miniaturization of connector devices has progressed. As a result, in such a probe inspection, the probe pin may simultaneously contact adjacent pin-shaped terminals. In this case, there arises a problem that it is difficult to accurately perform the inspection.

An object of the present disclosure is to provide a connector device or the like that can solve the above-described problems.

In order to solve the above-described problems, a connector device according to one aspect of the present disclosure includes a cable-side connector and a board-side connector. The cable-side connector has a cable-side housing and a plurality of cable connection terminals having pin-shaped contact portions, the cable connection terminal is configured to be connected to one end of a cable, and is provided in the cable-side housing, the board-side connector includes a board-side housing and a plurality of board fixing terminals, each board fixing terminal has a portion to be housed and an extending portion, the portion to be housed has an elastic contact piece and a closing portion, and is housed elastically displaceable inside each of a plurality of terminal housing spaces provided in the board-side housing, the extending portion extends to an outside through an opening of the terminal housing space, and is configured to be used by being fixed to a board, the elastic contact piece is configured to elastically contact the pin-shaped contact portion when the cable-side connector and the board-side connector are connected to each other, and the closing portion substantially closes the opening of the terminal housing space.

Further, according to the present embodiment, the board-side connector used for the connector device is provided.

According to this structure, the terminal having the elastic contact piece is used in the board-side connector that requires the probe inspection instead of the terminal having the pin-shaped contact portion. Thus, the probe pin can be brought into contact with the terminal more easily and reliably during the probe inspection. However, in this case, dust or potting material that flows in from the opening of the terminal housing space provided for housing the terminal having the elastic contact piece may hinder electrical contact of the terminal. However, the terminal having the elastic contact piece is provided with the closing portion that substantially closes the opening of the terminal housing space. Thus, such a gap is closed simply by housing the terminal in the terminal housing space. As a result, a dustproof function and a waterproof function can be improved. In addition, the potting material may be provided in order to improve waterproofness and vibration resistance. Also at this time, the potting material can be effectively restrained from flowing in from the opening.

In the connector device according to the above aspect, the closing portion may be formed by a portion of a plate-like portion of the board fixing terminal that is bent in a substantially L-shape along a surface forming the opening.

Moreover, in the connector device according to the above aspect, the closing portion may include two portions of the plate-like portion.

Further, in the connector device according to the above aspect, the two portions of the plate-like portion may form a seam in a direction perpendicular to both directions of a connection direction of the cable-side connector and the board-side connector and an arrangement direction of openings of the plurality of terminal housing spaces.

Furthermore, in the connector device of the above aspect, the two portions of the plate-like portion preferably have a symmetrical shape in the opening.

With this structure, the board fixing terminal is assembled by press-fitting or the like through the opening. At that time, it is possible to easily apply a force uniformly to a rear portion of a board fixing terminal by using the two portions of the plate-like portion. Therefore, a more stable and more reliable assembling work can be made.

Moreover, in the connector device of the above aspect, the board fixing terminal is preferably made of a single metal plate.

In the connector device of the above aspect, the portion to be housed of the board fixing terminal may be substantially box-shaped.

In the connector device according to the above aspect, the portion to be housed is preferably substantially housed inside the board-side housing.

With this structure, the probe pin can be more effectively restrained from contacting the adjacent terminals during the probe inspection.

In the connector device according to the above aspect, an insertion space and an internal housing are preferably provided in the board-side housing, the insertion space is preferably configured such that a portion of the cable-side housing is inserted therein when the cable-side connector and the board-side connector are connected to each other, and the internal housing is preferably disposed further behind the cable-side housing than the insertion space in an insertion direction of a portion of the cable-side housing, and preferably has the plurality of terminal housing spaces.

According to the present embodiment, the connector device and the board-side connector which can resolve the above problems are provided.

Hereinafter, a preferred example of the present embodiment will be described with reference to the accompanying drawings. For the convenience of explanation, only the preferred embodiment is shown. However, of course, the present disclosure is not limited to the embodiment.

Figure 2:
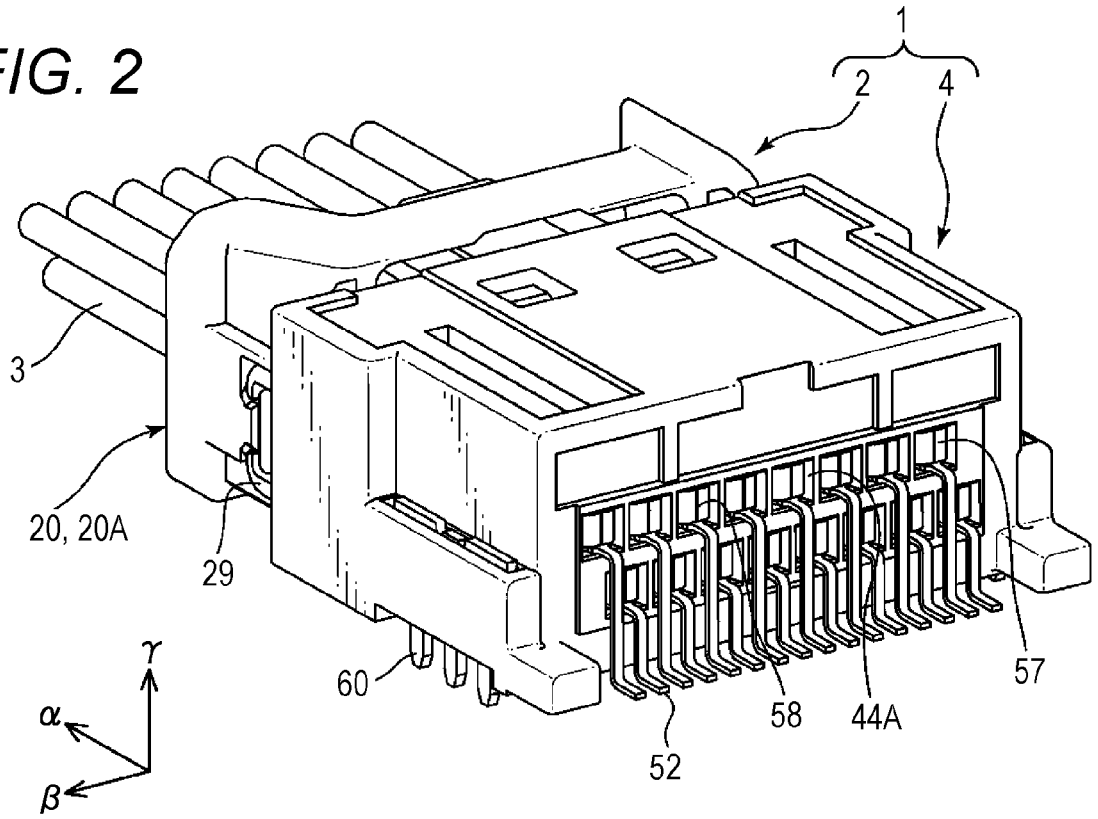
FIG. 2 is a perspective view of the connector device of FIG. 1 as viewed from a board-side connector side.
Figure 3:
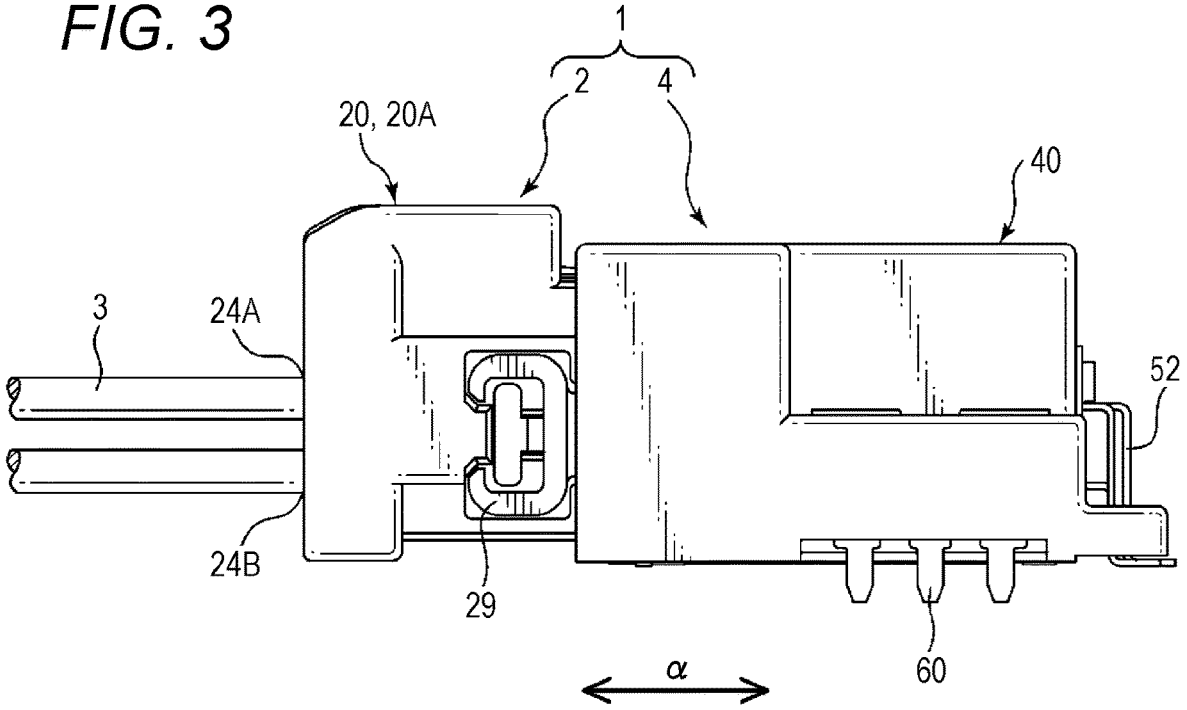
FIG. 3 is a side view of the connector device of FIG. 1.

FIGS. 1 to 3 show an example of a connector device 1 according to the present embodiment. The connector device 1 includes a set of a cable-side connector 2 and a board-side connector 4. FIG. 1 is a perspective view of the connector device 1 as viewed from the cable-side connector 2 side. FIG. 2 is a perspective view of the connector device 1 as viewed from the board-side connector 4 side. FIG. 3 is a side view of the connector device 1. In the connector device 1 shown in FIGS. 1 to 3, the cable-side connector 2 and the board-side connector 4 are all mated. Further, a cable 3 is connected to the cable-side connector 2.

Figure 4:
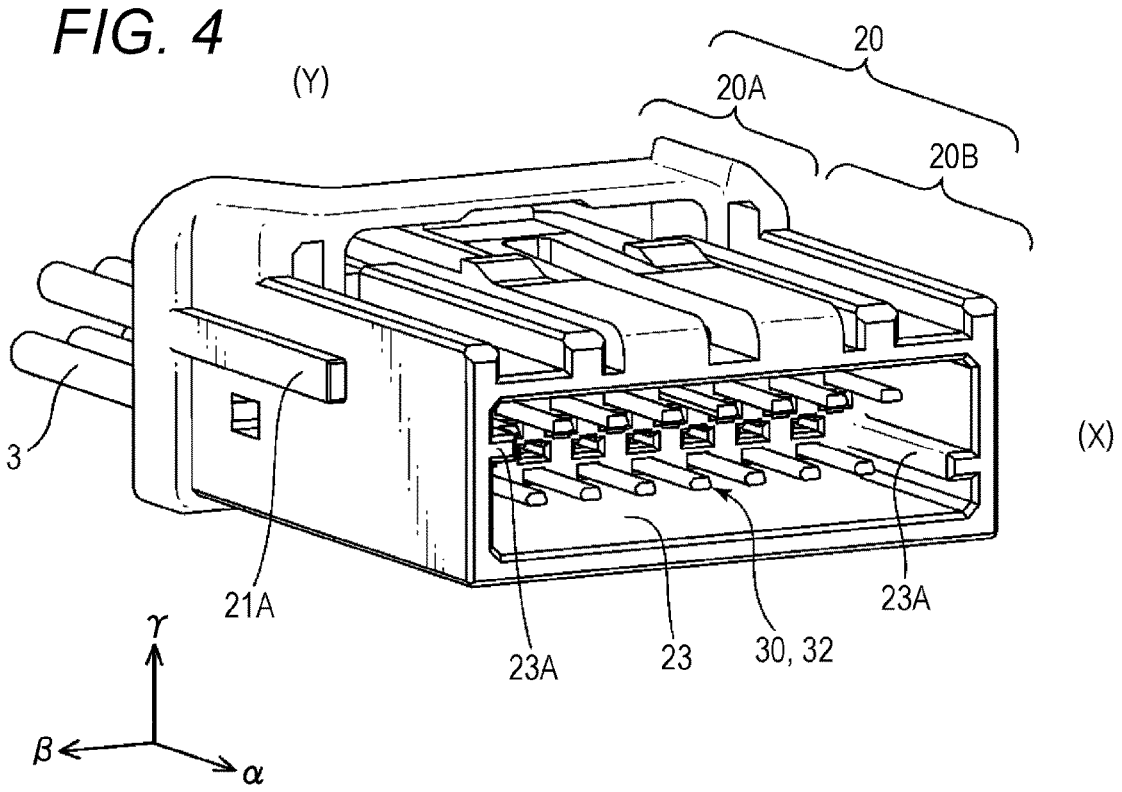
FIG. 4 is a perspective view of the cable-side connector before mating, as viewed from a connection side between the cable-side connector and the board-side connector.
Figure 5:
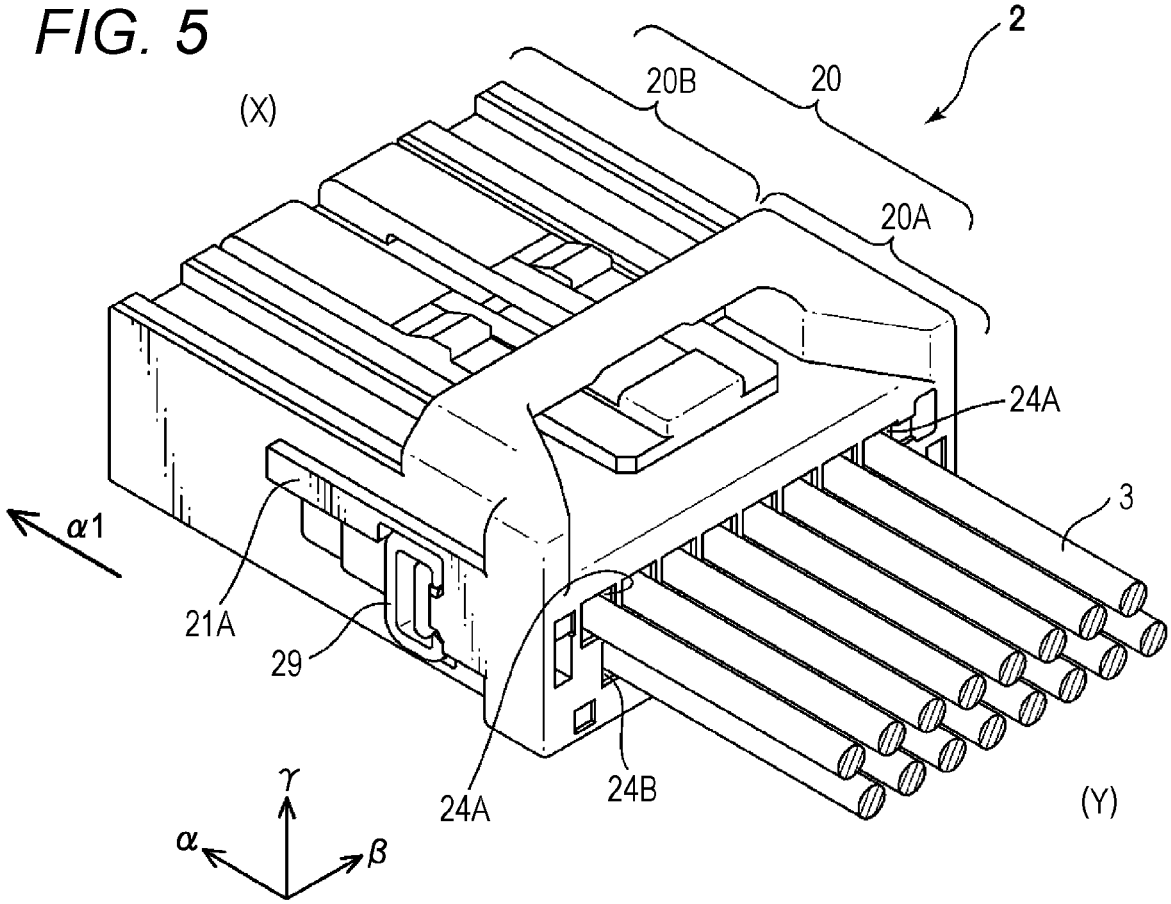
FIG. 5 is a perspective view of the cable-side connector of FIG. 4 as viewed from a side opposite to the connection side between the cable-side connector and the board-side connector.

FIGS. 4 and 5 show perspective views of only the cable-side connector 2. FIG. 4 is a perspective view of the cable-side connector 2 as viewed from a connection side (X) (hereinafter referred to as a "front side") with the board-side connector 4. FIG. 5 is a perspective view of the cable-side connector 2 as viewed from a side (Y) (hereinafter referred to as a "rear side") opposite to the connection side (X) with the board-side connector 4.

Figure 6:
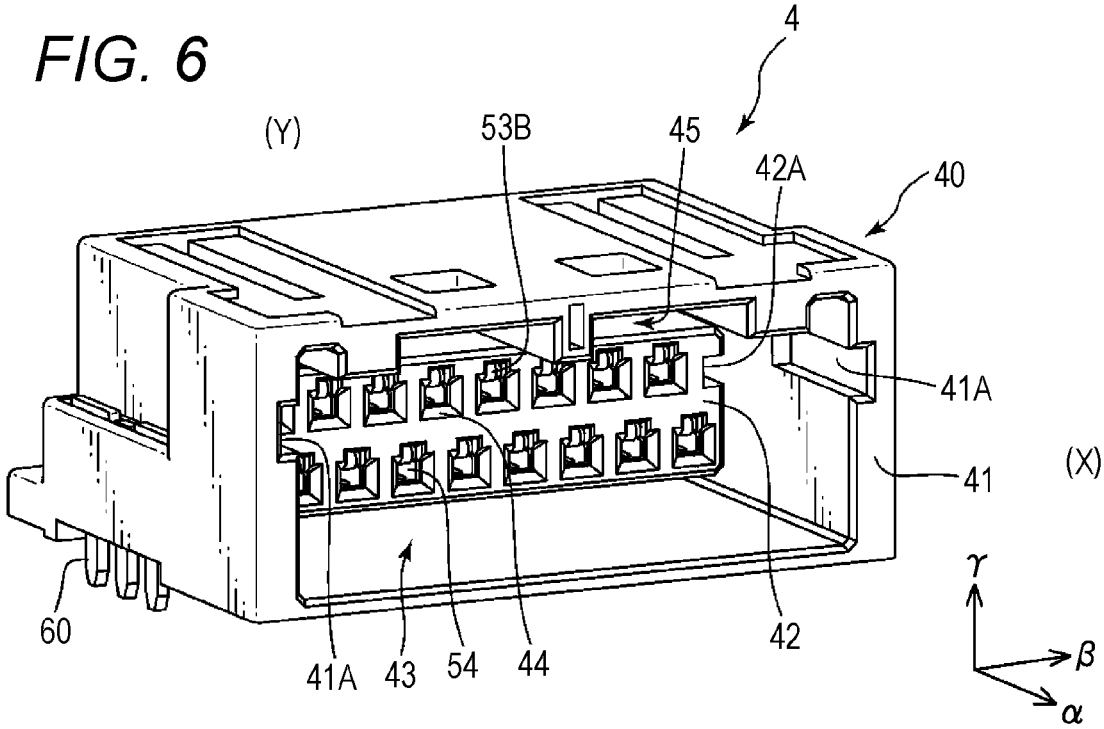
FIG. 6 is a perspective view of the board-side connector before mating, as viewed from the connection side between the cable-side connector and the board-side connector.
Figure 7:
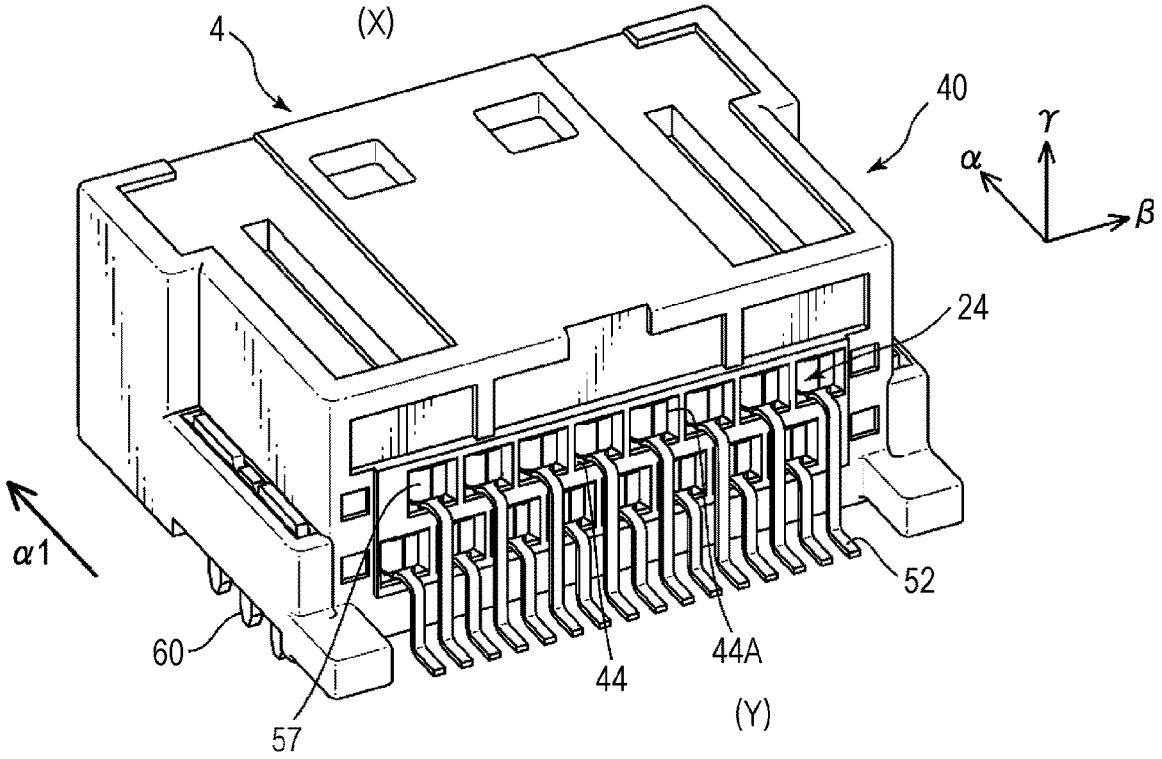
FIG. 7 is a perspective view of the board-side connector of FIG. 6 as viewed from the side opposite to the connection side between the cable-side connector and the board-side connector.
Figure 8:
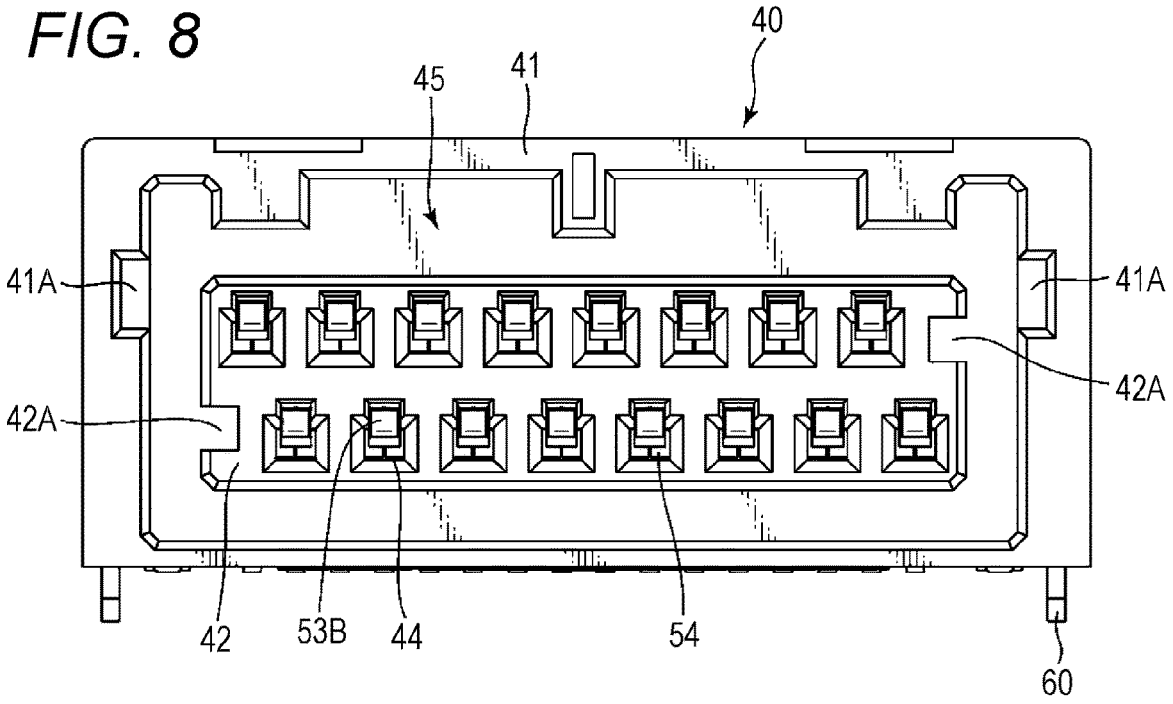
FIG. 8 is a front view of the board-side connector of FIG. 6.

Further, FIGS. 6 and 7 show perspective views of only the board-side connector 4. FIG. 6 is a perspective view of the board-side connector 4 as viewed from the front side (X). FIG. 7 is a perspective view of the board-side connector 4 as viewed from the rear side (Y). Further, FIG. 8 shows a front view of the board-side connector 4.

The cable-side connector 2 has a cable-side housing 20 and a plurality of cable connection terminals 30 (shown well in FIG. 4, and FIG. 9 described later) provided in the cable-side housing 20.

The cable-side housing 20 includes a substantially rectangular main body 20A and a frame protruding portion 20B having a rectangular frame-shaped cross-section. When the cable-side connector 2 and the board-side connector 4 are connected to each other, the substantially rectangular main body 20A is disposed on the rear side (Y), and the frame protruding portion 20B is disposed on the front side (X). Further, the frame protruding portion 20B extends in an "a" direction from the main body 20A toward the front side (X). When the cable-side connector 2 and the board-side connector 4 are mated, the frame protruding portion 20B is inserted into a predetermined portion of the board-side connector 4. As a result, as shown in FIGS. 1 to 3, only the main body 20A is exposed to an outside. A guide protrusion 23A for guiding the cable-side connector 2 when the cable-side connector 2 and the board-side connector 4 are mated is provided in the "α" direction on an inner side wall of the frame protruding portion 20B.

A plurality of terminal housing spaces 24 is provided in the main body 20A. Each terminal housing space 24 has a corresponding one cable connection terminal 30. Moreover, each terminal housing space 24 has a substantially rectangular shape in a cross-section ("β-γ" plane) perpendicular to the "α" direction. Further, the terminal housing space 24 penetrates the main body 20A in the "α" direction, and communicates with an insertion space 23 of the frame protruding portion 20B. At least one row in a width direction "β" of the main body 20A and multiple stages in a height direction "γ" of the main body 20A, for example, one row and two stages (24A, 24B) of the terminal housing spaces 24 are provided in the present embodiment. When the multiple stages of the terminal housing spaces 24 are provided as groups 24A and 24B of the terminal housing spaces 24, in order to avoid contact between the cable connection terminals 30, the group 24A of terminal housing spaces arranged in an upper stage and the group 24B of terminal housing spaces arranged in a lower stage are preferably arranged in a staggered manner as in the illustrated embodiment. One cable connection terminal 30 is inserted and fixed in each of the terminal housing spaces 24A and 24B.

Figure 9A:
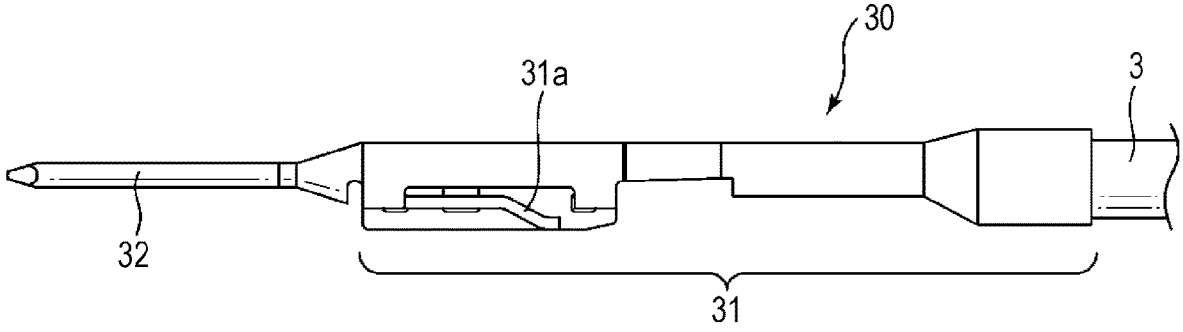
FIGS. 9A and 9B are a side view and a front view schematically showing an example of a cable connection terminal.
Figure 9B:
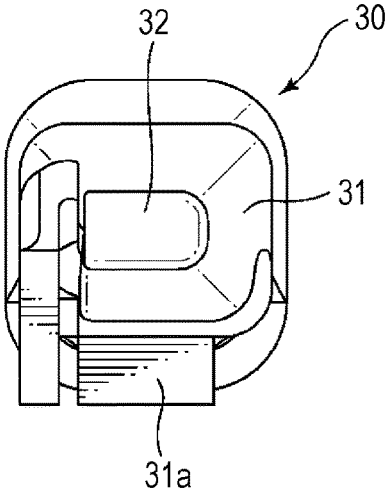

FIGS. 9A and 9B show an example of the cable connection terminal 30. FIG. 9A is a side view showing an outline of the cable connection terminal 30 connected to one end of the cable 3. FIG. 9B is a front view thereof.

The cable connection terminal 30 includes a main body 31 and a pin-shaped contact portion 32. The main body 31 is disposed on the rear side (Y) when the cable connection terminal 30 is housed in the terminal housing space 24. The contact portion 32 protrudes from the main body 31 to the front side (X). The "pin shape" in the present embodiment does not necessarily mean only an elongated shape. A shape having a small size in a plate thickness direction and a certain size in a plate surface direction is also included in the "pin shape".

The cross-section ("β-γ" plane) of the main body 31 has a substantially rectangular shape corresponding to a cross-sectional shape of the terminal housing space 24 except for a part of the middle. The main body 31 is connected to one end of the cable 3 on the rear side. The main body 31 connected to one end of the cable 3 is inserted into the terminal housing space 24. Thereafter, the main body 31 is fixed in the terminal housing space 24 by using the retainer 29. The cable connection terminal 30 is inserted into each terminal housing space 24 from the rear side (Y) to the front side (X) in a connection direction "al" between the cable-side connector 2 and the board-side connector 4. The main body 31 is provided with a fixing piece 31*a* that is engaged by the retainer 29 (FIG. 5). When the main body 31 is completely fixed in the terminal housing space 24, the pin-shaped contact portion 32 is disposed in a non-contact state in the insertion space 23 defined by the frame protruding portion 20B of the cable-side housing 20. A fixing method using the retainer 29 is well known. Therefore, the details are not described here.

The board-side connector 4 has a board-side housing 40 and a plurality of board fixing terminals 50 (shown well in FIGS. 6 to 8, and FIG. 10 described below) provided in the board-side housing 40.

The board-side housing 40 includes a substantially rectangular box-shaped external housing 41 that forms an outer shell of the board-side housing 40, and a substantially rectangular box-shaped internal housing 42. The internal housing 42 is disposed on the rear side (Y) inside the external housing 41 when the cable-side connector 2 and the board-side connector 4 are connected to each other. The rear side (Y) of the internal housing 42 is connected to the external housing 41 in a direction perpendicular to the "β-γ" plane. On the other hand, the front side (X) of the internal housing 42 extends in the "α" direction. An outer wall of the internal housing 42 and an inner wall of the external housing 41 define an insertion space 43. The insertion space 43 includes a gap 45 and has a rectangular frame-shaped cross-section belonging to the "β-γ" plane.

As described above, the insertion space 43 is formed in the external housing 41. When the cable-side connector 2 and the board-side connector 4 are connected to each other, a part of the cable-side housing 20, that is, the frame protruding portion 20B is inserted into the insertion space 43. In order to guide the frame protruding portion 20B to the insertion space 43, a guide protrusion 21A is provided in the "α" direction on an outer wall of the frame protruding portion 20B. Correspondingly, a guide groove 41A is provided in the "α" direction on the inner wall defining the insertion space 43 of the external housing 41. The internal housing 42 is positioned behind the cable-side housing 20 in an insertion direction "α1" from the insertion space 43 in the "α" direction. A guide groove 42A is provided in the "α" direction on the outer wall of the internal housing 42 so as to correspond to the guide protrusion 23A provided on an inner wall of the frame protruding portion 20B.

The internal housing 42 is provided with a plurality of terminal housing spaces 44. Each terminal housing space 44 has one corresponding board fixing terminal 50. Moreover, each terminal housing space 44 has a substantially rectangular shape in the cross-section ("β-γ" plane) perpendicular to the "α" direction. Further, each terminal housing space 44 penetrates the internal housing 42 in the "α" direction. Further, each terminal housing space 24 communicates with the insertion space 43 of the external housing 41 on the front side (X). Each terminal housing space 24 can be accessed from the outside on the rear side (Y) through an opening 44A provided on the rear side (Y). One board fixing terminal 50 is inserted into each terminal housing space 44 and provided in the terminal housing space 24. At positions corresponding to the terminal housing spaces 24 of the cable-side connector 2 and the cable connection terminals 30 provided therein, a corresponding number of terminal housing spaces 44 are provided.

Figure 10:
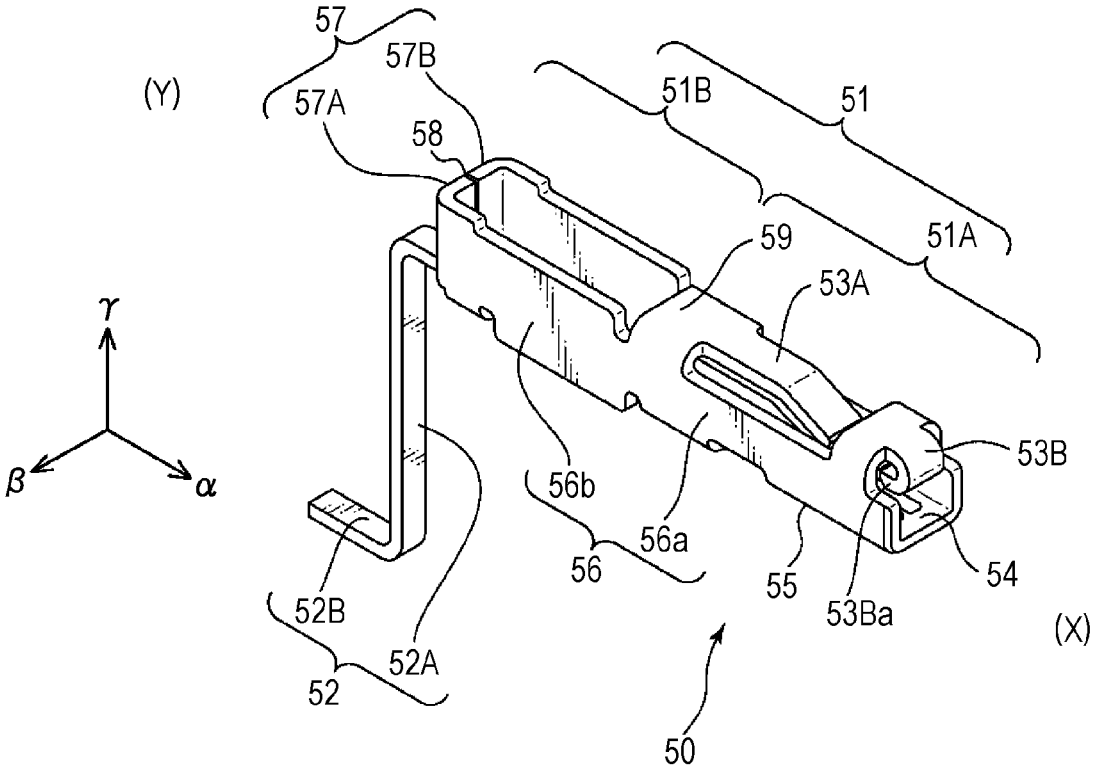
FIG. 10 is a perspective view of a board fixing terminal as viewed from above.
Figure 11:
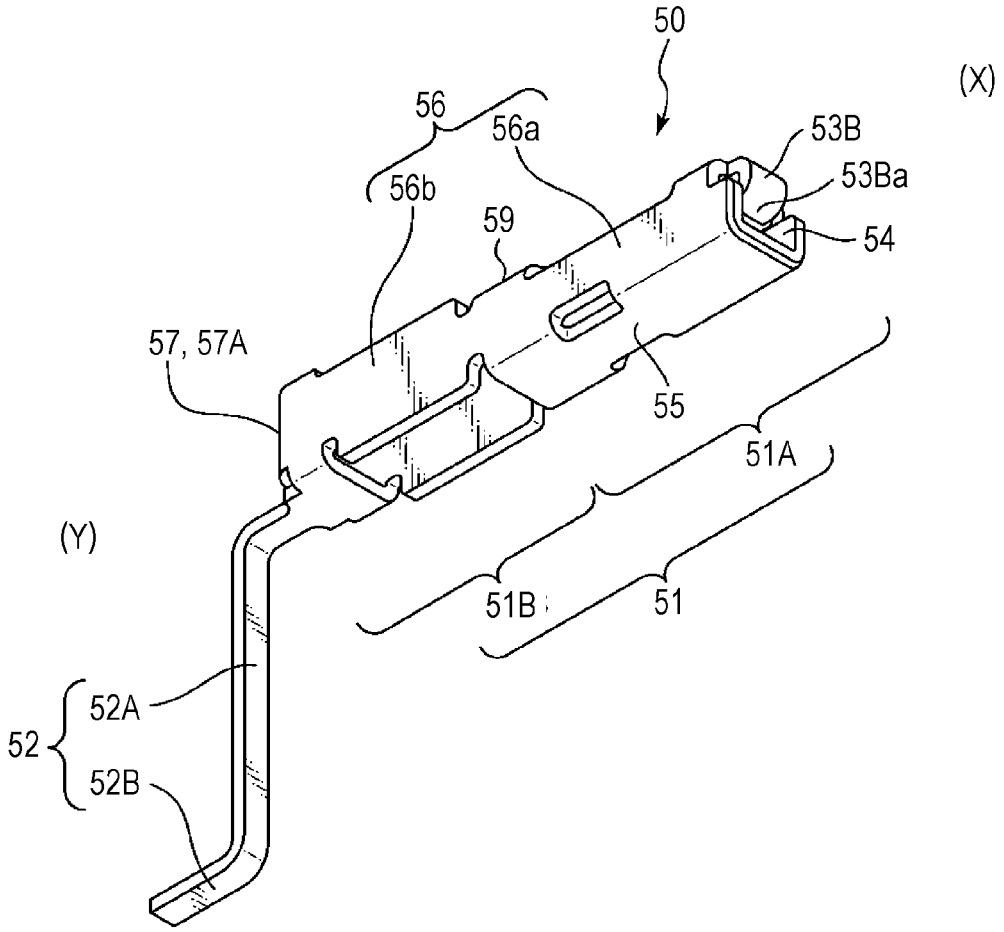
FIG. 11 is a perspective view of the board fixing terminal of FIG. 10 as viewed from a bottom side.

FIGS. 10 and 11 show an example of the board fixing terminal 50. FIG. 10 is a perspective view of the board fixing terminal 50 as viewed from above. FIG. 11 is a perspective view of the board fixing terminal 50 as viewed from a bottom side. As in the present embodiment, the board fixing terminal 50 is preferably formed by punching and bending a single metal plate. By using the single metal plate, it is possible to suppress generation of unnecessary gaps. The board fixing terminal 50 includes a substantially box-shaped main body 51 that is a portion to be housed in the terminal housing space 44, and a narrow plate-like leg 52.

The leg 52 is a portion that extends from the main body 51. Even after the main body 51 is housed in the terminal housing space 44, the leg 52 extends to the outside through the opening 44A of the terminal housing space 44. The leg 52 is bent in a substantially Z shape when viewed from a side. The leg 52 includes a vertical portion 52A extending to the board side and a fixing portion 52B that can be fixed to the board with solder or the like. In order to improve waterproofness and vibration resistance, the potting material is preferably provided near the leg 52. In order to reinforce a fixing force of the board-side connector 4 to the board, a reinforcing metal fitting 60 may be provided. In this case, the reinforcing metal fitting 60 may be soldered to the board.

The main body 51 includes a front portion MA and a rear portion 51B. The front portion 51A is disposed on the front side (X) when the main body 51 is housed in the terminal housing space 44. The rear portion 51B is disposed on the rear side (Y) and fixed in the terminal housing space 44 when the main body 51 is housed in the terminal housing space 44. Both the front portion 51A and the rear portion 51B have a substantially rectangular cross-section ("β-γ" plane) corresponding to the cross-sectional shape of the terminal housing space 44. Further, both the front portion 51A and the rear portion 51B are inserted into the terminal housing space 44.

When the board fixing terminal 50 is housed in the terminal housing space 44, the main body 51 is inserted from the front side (X) into the board-side housing 40, in particular, the internal housing 42, to be substantially housed. Here, "substantially housed" means that all portions of the main body 51 are housed in the terminal housing space 44 in the "α" direction. At this time, the main body 51 is not exposed to an outside of the terminal housing space 44. With such a structure of the board fixing terminal 50, it is possible to more effectively restrain the probe pin from simultaneously contacting the adjacent terminals during the probe inspection.

The front portion 51A of the board fixing terminal 50 mainly includes a bottom plate portion 55, two side plate portions 56*a* rising from both side surfaces and facing each other, and an upper plate portion 59 connected only to one side plate portion 56*a*. An insertion portion 54 is defined inside the main body 51 by the plate portions surrounding four sides. When the cable-side connector 2 and the board-side connector 4 are connected to each other, the pin-shaped contact portion 32 of the cable connection terminal 30 is inserted into the insertion portion 54. The upper plate portion 59 is formed as an elastic contact piece 53A extending to the front side (X) in a tongue-like shape. The elastic contact piece 53A is slightly bent from the upper plate portion 59 inwardly of the insertion portion 54. In this manner, the elastic contact piece 53A is provided to be elastically displaceable into the insertion portion 54. When the pin-shaped contact portion 32 is inserted into the insertion portion 54, the contact portion 32 and the elastic contact piece 53A are in elastic contact with each other. As a result, the cable connection terminal 30 and the board fixing terminal 50 are electrically connected to each other. A guide portion 53B is provided on the front side (X) of the front portion 51A in order to correct misalignment in an insertion direction of the contact portion 32 into the insertion portion 54. A tip end 53Ba of the guide portion 53B is curved in an inverted U shape inwardly of the insertion portion 54. The contact portion 32 can be guided to the insertion portion 54 by the guide portion 53B. The guide portion 53B has a relatively wide area portion on the front side (X). Accordingly, the guide portion 53B can also be used as a contacted portion that can be easily contacted by the probe pin during the probe inspection. Therefore, according to this structure, the probe pin can be more effectively restrained from simultaneously contacting the adjacent terminals.

The rear portion 51B of the board fixing terminal 50 includes a pair of side plate portions 56*b* continuous with the side plate portion 56*a* of the front portion 51A. The board fixing terminal 50 is press-fitted and fixed in the terminal housing space 44 at the rear portion 51B.

A closing portion 57, that substantially closes the opening 44A of the terminal housing space 44 when the board fixing terminal 50 is housed in the terminal housing space 44, is provided on the rear side (Y) of the rear portion 51B. Here, "substantially closes" means that when the opening 44A is closed using the closing portion 57, the opening 44A is closed without a gap so that inflow of the dust or the like or the inflow of the potting material provided near the leg 52 into the terminal housing space 44 or the insertion portion 54 of the board fixing terminal 50 through the opening 44A can be effectively suppressed. Therefore, even if a slight gap is generated, there is no problem. With this structure, the opening 44A can be substantially closed simply by housing the board fixing terminal 50 having such a closing portion 57 in the terminal housing space 44.

Figure 12:
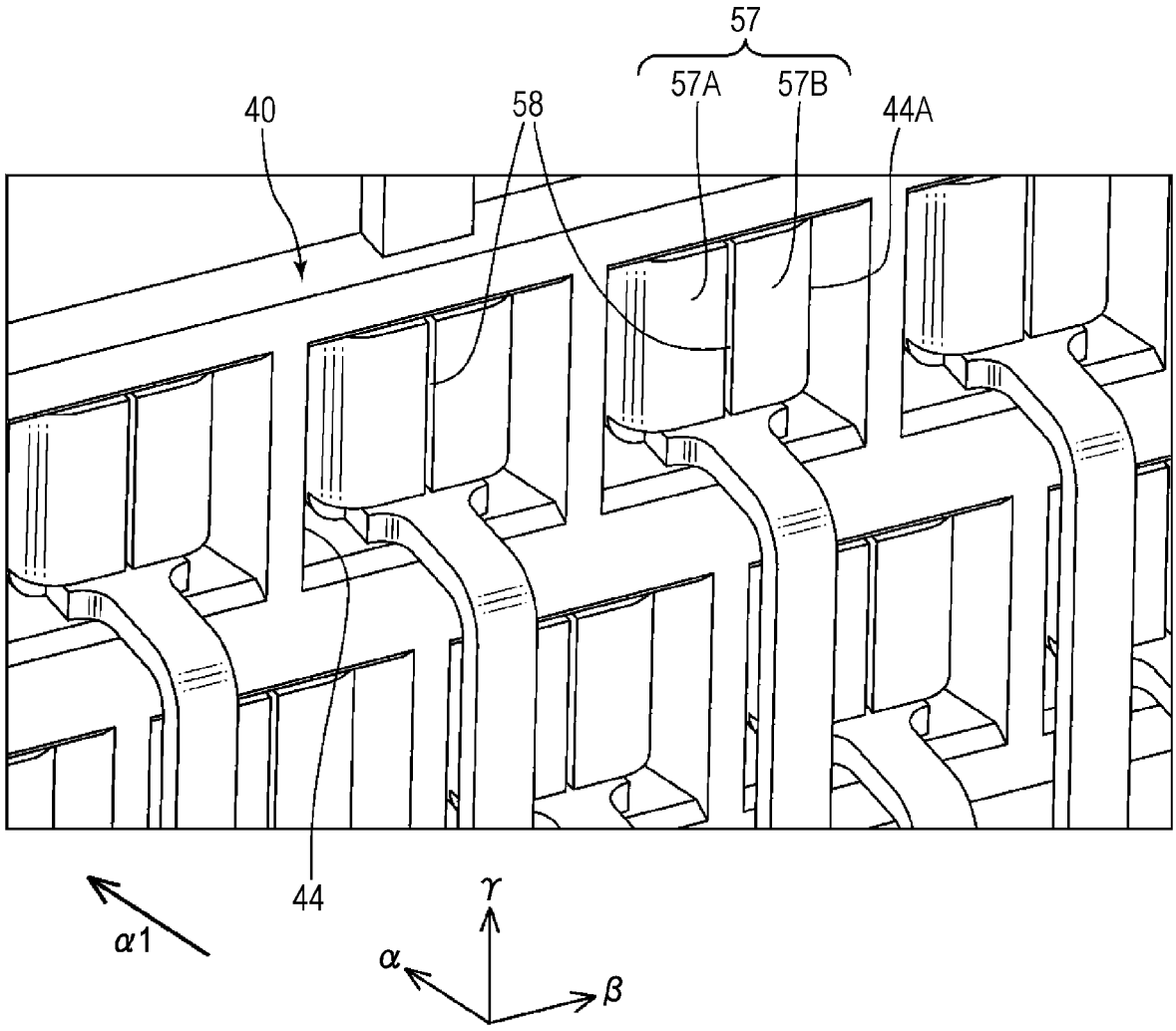
FIG. 12 is a partially enlarged view of FIG. 7.

FIG. 12 is a partially enlarged view of FIG. 7 showing a vicinity of the closing portion 57. As shown in the illustrated embodiment, the plate-like portion of the board fixing terminal 50, for example, a portion of each of a pair of side plate portions 56*a* may be bent in a substantially L-shape so as to be along the "β-γ" plane to which the opening 44A belongs, to form the closing portion 57. In this case, the pair of side plate portions 56*a* is bent to form two portions 57A and 57B. The two portions 57A and 57B forms a seam 58 in the direction "γ" perpendicular to both directions of a direction "α" in the connection direction "α1" between the cable-side connector and the board-side connector and an arrangement direction "β" of the openings 44A of the plurality of terminal housing spaces 44.

Further, the two portions 57A and 57B preferably have a symmetrical shape in the opening 44A as shown in the illustrated embodiment. The board fixing terminal 50 is incorporated into the terminal housing space 44 through the opening 44A by press-fitting or the like. By providing the closing portion 57 in a symmetrical shape, it is possible to easily apply a force uniformly to the rear portion of the board fixing terminal 50 using the two portions 57A and 57B. Therefore, a more stable and more reliable assembling work can be performed.

Finally, a method for connecting the cable-side connector 2 and the board-side connector 4 will be described. At the time of connection, first, the frame protruding portion 20B of the cable-side housing 20 is inserted into the insertion space 43 of the board-side housing 40. At this time, the guide protrusion 21A of the frame protruding portion 20B and the guide groove 41A of the external housing 41 provided corresponding thereto are used. The insertion direction is the same as the connection direction "α1" between the cable-side connector 2 and the board-side connector 4. As insertion proceeds, the frame protruding portion 20B is inserted into the insertion space 43 defined by the outer wall of the internal housing 42 and the inner wall of the external housing 41. Further, at substantially the same time, the guide protrusion 23A provided on the inner wall of the frame protruding portion 20B is fitted into the guide groove 42A provided on the outer wall of the internal housing 42. Thus, the cable-side connector 2 is more stably guided to the board-side connector 4 in the "α" direction. When the insertion further proceeds, the pin-shaped contact portion 32 of the cable connection terminal 30 of the cable-side connector 2 is inserted into the insertion portion 54 of the board fixing terminal 50 provided in the board-side connector 4. The contact portion 32 is brought into elastic contact with the elastic contact piece 53A of the board fixing terminal 50. As a result, the cable connection terminal 30 and the board fixing terminal 50 are also electrically connected to each other.

The present embodiment is not limited to the embodiment described above. Various other modifications can be made.

For example, in the embodiment described above, the closing portion 57 is formed of two portions 57A and 57B. However, the closing portion 57 is not necessarily formed of two portions. The closing portion 57 may be formed of only one portion. Further, the direction in which the plate-like portion of the board fixing terminal 50 is bent is not necessarily the "γ" direction. For example, the direction may be the "β" direction.

The fact that the present embodiment has further aspects, features, and advantages will be easily understood from the above detailed description in which only a specific embodiment and example, including the best mode intended to implement the present embodiment are described. Moreover, the present embodiment can also be constituted by other different embodiments. Also, many details can be changed from various obvious viewpoints, without departing from the spirit and scope of the present embodiment. Accordingly, the drawings and descriptions are merely examples. The present embodiment is not limited to the drawings and description.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector device comprising:

a cable-side connector; and a board-side connector, wherein the cable-side connector has a cable-side housing and a plurality of cable connection terminals having pin-shaped contact portions, the cable connection terminal is configured to be connected to one end of a cable, and is provided in the cable-side housing, the board-side connector includes a board-side housing and a plurality of board fixing terminals, each board fixing terminal has a portion to be housed and an extending portion, the portion to be housed has an elastic contact piece and a closing portion, and is housed elastically displaceable inside each of a plurality of terminal housing spaces provided in the board-side housing, the extending portion extends to an outside through an opening of the terminal housing space, and is configured to be used by being fixed to a board, the elastic contact piece is configured to elastically contact the pin-shaped contact portion when the cable-side connector and the board-side connector are connected to each other, the closing portion substantially closes the opening of the terminal housing space, the portion to be housed has, on a side facing the cable-side connector, an insertion portion configured to have the pin-shaped contact portion inserted thereinto, and the insertion portion is defined by a bottom plate portion, two side plate portions rising from both sides of the bottom plate portion and facing each other, and an upper plate portion connected only to one of the side plate portions.

2. The connector device according to claim 1, wherein the closing portion is formed by a portion of a plate-like portion of the board fixing terminal that is bent in a substantially L-shape along a surface forming the opening.

3. The connector device according to claim 2, wherein the closing portion includes two portions of the plate-like portion.

4. The connector device according to claim 3, wherein the two portions of the plate-like portion form a seam in a direction perpendicular to both directions of a connection direction of the cable-side connector and the board-side connector and an arrangement direction of openings of the plurality of terminal housing spaces.

5. The connector device according to claim 4, wherein the two portions of the plate-like portion have a symmetrical shape in the opening.

6. The connector device according to claim 1, wherein the board fixing terminal is made of a single metal plate.

7. The connector device according to claim 1, wherein the portion to be housed of the board fixing terminal is substantially box-shaped.

8. The connector device according to claim 1, wherein the portion to be housed is substantially housed inside the board-side housing.

9. The connector device according to claim 1, wherein an insertion space and an internal housing are provided in the board-side housing, the insertion space is configured such that a portion of the cable-side housing is inserted therein when the cable-side connector and the board-side connector are connected to each other, and the internal housing is disposed further behind the cable-side housing than the insertion space in an insertion direction of a portion of the cable-side housing, and has the plurality of terminal housing spaces.

10. A board-side connector according to claim 1.

11. The connector device according to claim 1, wherein the elastic contact piece is bent from the upper plate portion inwardly of the insertion portion.

* * * * *